United States Patent [19]

Burditt

[11] Patent Number: 4,590,481

[45] Date of Patent: May 20, 1986

[54] FOCAL FINDER FOR PARABOLIC REFLECTOR ANTENNA

[76] Inventor: Vernon K. Burditt, 912 W. Main, Ness City, Kans. 67560

[21] Appl. No.: 523,014

[22] Filed: Aug. 15, 1983

[51] Int. Cl.[4] ..... H01Q 1/00

[52] U.S. Cl. ..... 343/840; 343/894

[58] Field of Search ..... 343/703, 760, 840, 894

[56] References Cited

U.S. PATENT DOCUMENTS

B 563,244 1/1976 Blanchard et al. ..... 343/840

3,178,713 4/1965 Yang ..... 343/840

*Primary Examiner*—Eli Lieberman

*Attorney, Agent, or Firm*—Schmidt, Johnson, Hovey & Williams

[57] ABSTRACT

A compact, easily manipulable measuring device is provided, particularly useful for properly positioning the feed horn of a parabolic reflector antenna, or the like, relative to the satellite reflecting dish of the antenna. When installing or maintaining an antenna, it is important for optimum signal reception to position the feed horn at or near the focal point of the satellite dish. Such feed horns typically present a central axis, which if aligned with the center point of the satellite dish approximately positions the feed horn at the focal point of the satellite dish. The device of the present invention presents a telescopic rod structure coupled to a support head. The support head presents structure for attachment to the feed horn such that the rod structure preferably lies along the feed horn central axis. With the rod structure extended to a position adjacent the satellite dish, it is readily apparent whether the feed horn central axis is aligned with the satellite dish center point or if adjustment of the feed horn is necessary.

13 Claims, 5 Drawing Figures

Fig. 1
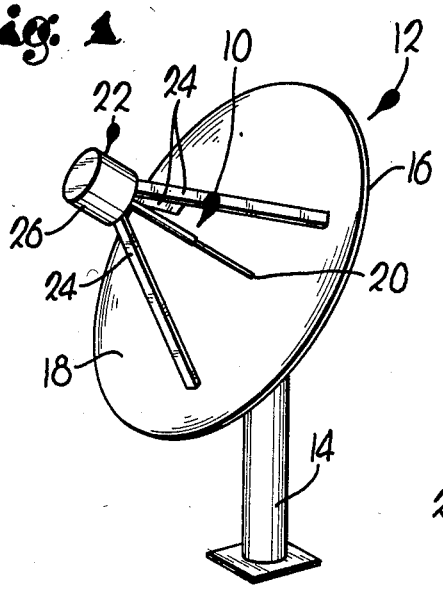
Fig. 2
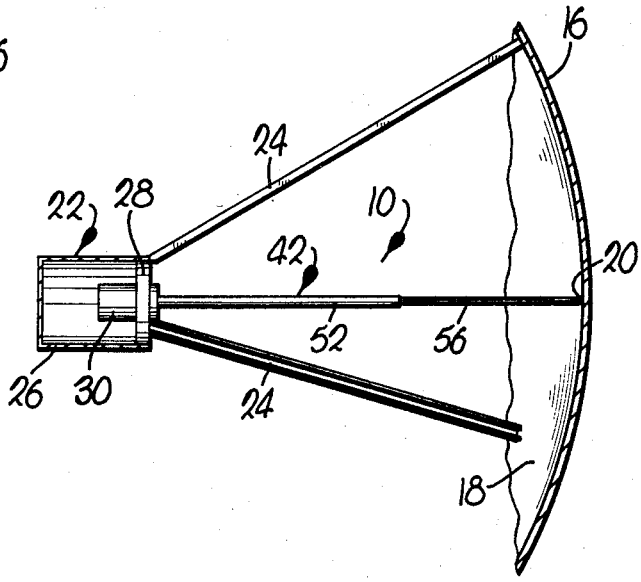
Fig. 3
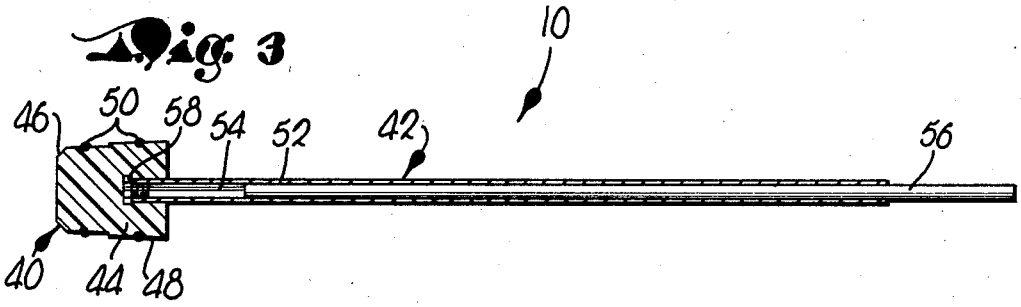
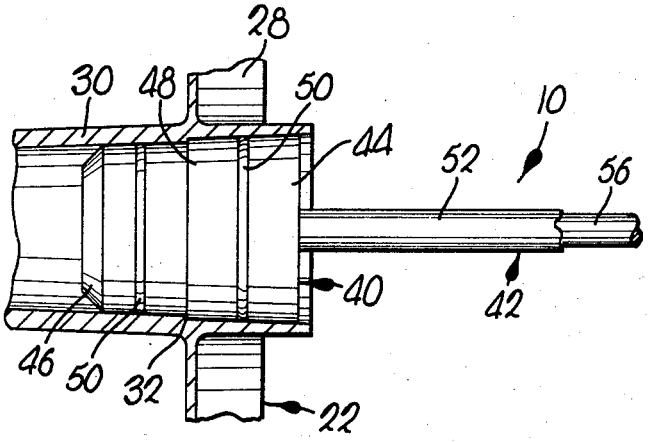
Fig. 4
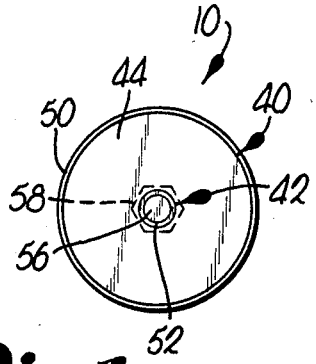
Fig. 5

FOCAL FINDER FOR PARABOLIC REFLECTOR ANTENNA

BACKGROUND OF THE INVENTION

1. Field of the Invention

This invention relates generally to a measuring device for attachment to the feed horn of a parabolic reflector antenna, for aiding in the proper positioning of the feed horn relative to the satellite reflecting dish of the antenna for optimum signal reception. More particularly, it is concerned with such a measuring device having a telescopically interfitted elongated rod structure secured at one end thereof to a support head, with the support head having engagement structure for attachment to the feed horn whereby the rod structure is oriented along the central axis of the feed horn making it an easy matter to align the feed horn central axis with the center point of the satellite dish.

2. Description of the Prior Art

Although reception antennas for receiving signals from earth orbiting satellites are broadly known, recently such antennas have gained widespread use among a much broader population base. That is, with the advent of satellite television, many people have purchased relatively low cost satellite reception dishes for their personal use. In such antennas, a feed horn is positioned above the surface of the dish in such a manner to received electromagnetic signals reflected by the concave surface of the dish. As can be appreciated, it is desirable to position the feed horn of such an antenna approximately at the focal point of the reflecting dish for optimum reception of the reflected signals. Although expensive methods and calibration equipment have been devised for positioning feed horn of a satellite dish, there has heretofore existed a need in the art for an inexpensive measuring device which is easily attachable to the feed horn and readily indicates to the operator the relative position of the central axis of the feed horn to the center of the satellite dish.

SUMMARY OF THE INVENTION

The measuring device in accordance with the present invention generally fulfills the need in the art for such an inexpensive, easy to use device. That is to say, the device hereof is easily attachable to the feed horn of a parabolic reflector antenna and quickly indicates to the operator the relative position of the feed horn to the satellite dish. Thus, the device hereof provides an inexpensive way to quickly adjust the feed horn to the approximate position of the focal point of such a parabolic reflector antenna.

The feed horn in accordance with the present invention broadly includes a support head including means for attaching the head to the feed horn in a predetermined orientation, and rod means operatively coupled to the support head. Advantageously, the rod means includes an elongated first member secured to the support head at a predetermined angular relationship, an elongated second member having one end disposed adjacent the first member, and means for operatively coupling the second member to the first member at a certain angular relationship whereby the second member other end is positionable adjacent the satellite dish. Positioning the second member other end adjacent the dish gives not only a ready indication of the position of the rod means relative a reference point on the satellite dish, but also, indicates the relative orientation of the feed horn to the satellite dish. In particularly preferred forms, the rod means first and second members are telescopically interfitted and coaxial, with the support head attachment means aligning the telescopic rods along the desired axis of the feed horn. In the preferred embodiment, the feed horn presents a cylindrical socket, it being desirable to align the central axis of the cylindrical socket with the center point of the satellite dish. To this end, the support head is circular in cross-section for the sliding reception of the support head within the socket and the telescopic rods are secured to the support head in such a manner that the rods are aligned with the socket central axis. Telescoping the rods into an extended position places the end of one of the rods adjacent the satellite dish, which if properly aligned will contact the center point of the dish.

BRIEF DESCRIPTION OF THE DRAWING

FIG. 1 is a perspective view of a parabolic reflector antenna with the device of the present invention attached to the feed horn of the antenna;

FIG. 2 is a fragmentary, vertical sectional view of a parabolic antenna depicting the device of the present invention operatively coupled thereto;

FIG. 3 is a vertical sectional view of the device of the present invention;

FIG. 4 is a fragmentary, somewhat enlarged, sectional view illustrating the engagement of the device of the present invention with the feed horn of the antenna; and FIG. 5 is a top view of the device of the present invention.

DESCRIPTION OF THE PREFERRED EMBODIMENT

Referring now to the drawing, a measuring device 10 particularly useful in the installation and maintenance of a parabolic reflector antenna 12 is depicted. It should be appreciated that parabolic reflector antennas can present a wide variety of structural features, with the antenna 12 herein described being used for illustrative purposes only. As illustrated in FIG. 1, such a parabolic reflector antenna 12 broadly includes a base 14, a satellite dish 16 having a concave reflecting surface 18 and a center point 20, as well as a feed horn assembly structure 22. In FIGS. 1, 2 and 4, a typical feed horn assembly 22 is shown and includes a plurality of elongated support struts 24, each having one end connected to the dish 16 and outwardly converging for connection at the other end to a signal reception mechanism 26. The signal reception mechanism 26 comprises a plurality of coaxial, concentric pickup cylinders 28, with the innermost cylinder presenting a somewhat elongated cylinder defining a central socket 30. As shown in more detail in FIG. 4, the central socket 30 has slightly tapered socket defining walls and includes an inwardly-extending annular shoulder 32.

In more detail (see particularly FIG. 3), the measuring device 10 of the present invention broadly includes a support head structure 40 which is fixedly interconnected to a telescopic rod assembly 42. The support head 40 preferably presents a slightly elongated, generally cylindrical body 44 having slightly tapered walls which converge at bevel 46 at one end thereof. As shown in FIGS. 3 and 4, the body 44 further includes an outwardly-extending, circumscribing boss structure 48 and a pair of circumscribing O-rings 50. The telescopic rod assembly 42 of the preferred embodiment presents an elongated, tubular, cylindrically-shaped first rod component 52 having an internal axial bore 54 therein. An elongated, cylindrically-shaped second rod component 56 is telescopically received within the bore 54. As seen in FIGS. 3, 5, a plug 58 (in the form of a hexhead bolt) is received in one end of the first rod component 52 blocking the bore 54 for purposes which will be made clear.

As can be appreciated, the body 44 is preferably of a molded plastic construction, and therefore, telescopic rod assembly 42 is inserted in the mold with the plug 58 blocking the bore 54 from entry of the plastic material. In the preferred embodiment, the body 44 and telescopic rod assembly 42 are coaxial, that is, the elongated telescopic rod assembly 42 is simply operative along the central axis of the support head 40. As those skilled in the art will appreciate, it is desirable that the angular relationship between the telescopic rod assembly 42 and support head 40 be known, with the coaxial relationship being the preferred construction.

Operation of the device 10 can be readily appreciated when viewed in the overall context of the assembly or maintenance of a typical parabolic reflector antenna 12 as illustrated in FIG. 1. In such antenna, it is highly desirable in order to achieve optimum signal reception from an earth orbiting satellite, that the feed horn assembly 22 be positioned approximately at the focal point of the satellite dish 16. To this end, the signal reception mechanism 26 is adjustably secured to the struts 24 for positioning approximately at the focal point. In the antenna 12 used for illustrative purposes, the central socket 30 is cylindrical in shape and if the central axis of the socket 30 is aligned with the center point 20 of the dish 16, then the signal reception mechanism 26 will be at the approximate location of the focal point. Heretofore, the positioning of the mechanism 26 at the focal point was accomplished either by trial and error or using expensive calibration equipment. The device 10 of the present invention quickly and inexpensively solves this positioning problem by its unique constructional features.

In use, the support head 40 is inserted into the socket 30 in such a fashion that the socket 30 and body 44 are coaxial. Thus, the body 44 is inserted into the socket 30 until the boss 48 engages the shoulder 32 with the O-rings 50 providing additional assurance that the body 44 is centered, secure and coaxial with the socket 30. During this initial assembly, the second rod component 56 is preferably telescopically received within the bore 54 to the extent necessary to permit easily manipulability of the device 10 within the antenna 12. With the support head 40 received within the socket 30, the second rod component 56 is then telescoped to the extent necessary until the end of the second rod component 56 contacts the reflecting surface 18 of the dish 16. In this configuration, the distance between the end of the rod 56 and the center point 20 indicates the relative disposition of the central axis of the socket 30 to the center point 20. With this relationship known, the operator can easily reposition the signal reception mechanism 26 until the central axis of the socket 30 is aligned with the center point 20 of the dish 16, that is, the second rod component 56 should contact the concave reflecting surface 18 approximately at the center point 20. When aligned, the signal reception mechanism 26 is approximately positioned at the focal point of the satellite dish 16, thereby optimizing signal reception of the antenna 12. With the positioning complete, the device 10 is easily removed by simply grasping the first rod component 52 and pulling longitudinally, thereby disengaging the body 44 from the socket 30.

As those skilled in the art will appreciate, many modifications can be made to the device 10 without departing from the scope of the invention. For example, in an alternative embodiment, the second rod component 56 includes a graduated measuring scale imposed thereon so that with the length of the first rod component 52 known, the approximate distance of the signal reception mechanism 26 from the center point 20 can be determined. In many types of installation, the linear distance between the center point 20 and the reception mechanism 26 is an invaluable aid in properly positioning the feed horn assembly 22. Further, many types of feed horn assemblies 22 present different types of structure encompassing their signal reception mechanism 26. In this case, the support head 40 would contemplate a suitable attachment structure so that the telescopic rod assembly 42 is coaxially aligned with the signal reception mechanism 26. If coaxial alignment is not possible, it is desirable to at least know the angular relationship between the signal reception mechanism 26, the first rod component 52, and the second rod component 56. Knowing the angular interrelationship, will indicate to the operator the angular relationship between the signal reception mechanism 26 and the center point 20 of the satellite dish 16.

I claim:

1. A device particularly useful for positioning the feed horn or the like of an antenna, relative the reflecting dish of the antenna, said device comprising:

a support head including means for temporarily coupling said head to the feed horn of an antenna in a predetermined orientation; and rod means operatively coupled to said support head for determining the relative orientation of the feed horn to a reference point on the reflecting dish of an antenna, said rod means including an elongated first member secured to said support head at a predetermined angular relationship, an elongated second member having one end disposed adjacent said first member, and means for operatively coupling said one end of the second member to said first member at a certain angular relationship and operable for positioning the other end of said second member adjacent said satellite dish whereby the relative position of said other end to said reference point on said satellite dish indicates the relative orientation of said feed horn to said reference point.

2. A device as set forth in claim 1, said second member being slidably coupled to said first member in a parallel relation whereby said second member is oriented relative said support head at the same predetermined angular relationship as said first member.

3. A device as set forth in claim 1, said first member having structure defining an elongated bore therein and said second member being telescopically received within said bore.

4. A device as set forth in claim 1, said rod means including scale means for determining the linear distance between said reference point and said feed horn.

5. A device as set forth in claim 3, said second member having a graduated scale marked on the surface thereof for determining the linear distance of said feed horn from said reference point.

6. A device particularly useful for positioning the feed horn or the like of an antenna, relative the reflecting dish of the antenna, said device comprising:

a support head including means for attaching said head to the feed horn of an antenna in a predetermined orientation, said feed horn having structure defining a socket therein and said support head being complementally dimensioned for operative reception within said socket; and rod means operatively coupled to said support head for determining the relative orientation of the feed horn to a reference point on the reflecting dish of an antenna, said rod means including–an elongated first member secured to said support head at a predetermined angular relationship, an elongated second member having one end disposed adjacent said first member, and means for operatively coupling said one end of the second member to said first member at a certain angular relationship and operable for positioning the other end of said second member adjacent said satellite dish whereby the relative position of said other end to said reference point on said satellite dish indicates the relative orientation of said feed horn to said reference point.

7. A device as set forth in claim 6, said socket and said support head being circular in cross-section with said support head presenting an O-ring circumscribing the perimeter of said support head, said O-ring operatively centering and operatively retaining said head in said socket.

8. A device as set forth in claim 7, said first member being fixedly secured to said head in such a manner that with said device attached to said feed horn, the central axes of said socket, support head, and first member are coaxial.

9. A device as set forth in claim 6, said socket-defining structure presenting an inwardly-extending shoulder and said head presenting an outwardly-extending engagement surface whereby said engagement surface contacts said shoulder when said head is properly positioned in said socket.

10. A device as set forth in claim 8, said first member having structure defining an elongated bore therein and said second member being telescopically received in said bore coaxial with the center of said socket.

11. A device as set forth in claim 10, said feed horn having structure defining a cylindrically-shaped socket about the central axis and said support head presenting a circular in cross-section body for the sliding reception of said head within the socket in a coaxial orientation.

12. A device as set forth in claim 10, said body being tapered.

13. A device as set forth in claim 10, said second rod having a distance measuring scale affixed to the outer surface thereof.

* * * * *